US005509785A

United States Patent [19]

Lin

[11] Patent Number: 5,509,785

[45] Date of Patent: Apr. 23, 1996

[54] IMPELLER OF MOTORBOAT

[76] Inventor: Solas Y. J. Lin, 37, 35th Road Taichung Industrial Park, Taichung, Taiwan

[21] Appl. No.: 232,633

[22] Filed: Apr. 26, 1994

[51] Int. Cl.[6] ..... B63H 1/20

[52] U.S. Cl. ..... 416/244 B; 416/146 R; 416/245 A; 81/461; 81/176.15; 81/124.2

[58] Field of Search ..... 416/93 A, 188, 416/244 R, 244 B, 245 A, 146 R; 81/461, 176.15, 176.2, 124.2

[56] References Cited

U.S. PATENT DOCUMENTS

| | | | |
|---|---|---|---|
| 1,674,543 | 6/1928 | Clifton | 416/244 R |
| 2,605,850 | 8/1952 | Kiekhaefer | 416/244 B |
| 3,904,301 | 9/1975 | Schroeder | 416/244 R |
| 3,957,394 | 5/1976 | Chaskin | 416/244 B |

FOREIGN PATENT DOCUMENTS

| | | | |
|---|---|---|---|
| 616293 | 1/1927 | France | 416/244 B |
| 716090 | 12/1941 | Germany | 416/244 R |

*Primary Examiner*—Edward K. Look
*Assistant Examiner*—James A. Larson
*Attorney, Agent, or Firm*—Browdy and Neimark

[57] ABSTRACT

A motorboat impeller comprises an axial portion having a through axial hole and having a plurality of blades mounted around the periphery thereof and further having a plurality of retaining slots in the inner wall of the through axial hole. The retaining slots have a predetermined depth and a predetermined length extending from the front end of the axial portion toward the inside of the axial portion along the direction of the axis of the axial portion. A mounting and dismounting element can be disposed in the retaining slots and is provided with a body of a polygonal construction and having a plurality of retaining blocks extending outwards. The retaining blocks are dimensioned to fit into the retaining slots. The body of the mounting and dismounting element can be held firmly with a hand tool to facilitate the turning of the axial portion.

7 Claims, 4 Drawing Sheets

IMPELLER OF MOTORBOAT

FIELD OF THE INVENTION

The present invention relates generally to the impeller of a motorboat, and more particularly to an improved streamline impeller of motorboat which can be mounted and dismounted with a special tool.

BACKGROUND OF THE INVENTION

Generally speaking, there are two methods by which the motorboat impeller is fastened with the motorboat driveshaft. The first method includes a impeller which is provided centrally with a threaded axial hole engageable with a threaded portion located at the tail end of a driveshaft. The second method includes a impeller which is provided centrally with an axial hole having therein a predetermined number of serrated slots which extend along the direction of the axis of the axial hole and which are engageable with splines disposed on the tail end of a driveshaft. The motorboat impeller of the present invention relates to the first fastening method described above.

As shown in FIGS. 1 and 2, a conventional motorboat impeller 10 of the prior art comprises an axial portion 12 and three blades 14 fastened to the periphery of the axial portion 12. Located at the center of the axial portion 12 is an axial hole 16 extending through the axial portion 12. The axial hole 16 is provided in the rear end thereof with a female threaded portion 17 engageable with a male threaded portion located at the tail end of a driveshaft (not shown in the drawings). The axial portion 12 has a smooth external surface, which can not be held firmly with a tool at such time when the work of fastening the impeller 10 with the driveshaft is under way. For this reason, the prior art motorboat impeller 10 is provided with a hexagonal portion 13 contiguous to the axial portion 12 and extending along the direction of the axis of the impeller 10.

As shown in FIG. 2, the hexagonal portion 13 has six sides 131, which can be held firmly with an appropriate wrench to facilitate the work of fastening the impeller 10 with the driveshaft. However, the prior art motorboat impeller 10 described above is defective in design in that the hexagonal portion 13 has six corners 132, which are responsible for the formation of water bubbles, turbulent waves and cavitation at the time when the impeller 10 is driven by the driveshaft to turn at a high speed in the water. In other words, the operation of the prior art motorboat impeller 10 can bring about a severe vibration of the motorboat and a substantial reduction in the thrust of the impeller 10.

SUMMARY OF THE INVENTION

It is therefore the primary objective of the present invention to provide an improved motorboat impeller which overcomes the shortcomings of the prior art motorboat impeller described above.

It is another objective of the present invention to provide an improved motorboat impeller with an axial portion having a rubber nose portion fastened to the front end thereof.

The foregoing objectives of the present invention are attained by a motorboat impeller which comprises an axial portion having a through axial hole and having a plurality of blades mounted around the outer edge thereof. The motorboat impeller is characterized in that it further comprises a plurality of retaining slots in the inner wall of the through axial hole. The retaining slots have a predetermined depth and a predetermined length extending from the front end of the axial portion toward the inside of the axial portion along the direction of the axis of the axial portion. A mounting and dismounting element can be disposed in the retaining slots. The mounting and dismounting element has a body with a polygonal outer edge and with a plurality of retaining blocks extending outwards therefrom. The retaining blocks are dimensioned to fit into the retaining slots. The outer edge of the body can be held firmly with a hand tool to facilitate the turning of the axial portion.

DETAILED DESCRIPTION OF THE INVENTION

Figure 1:
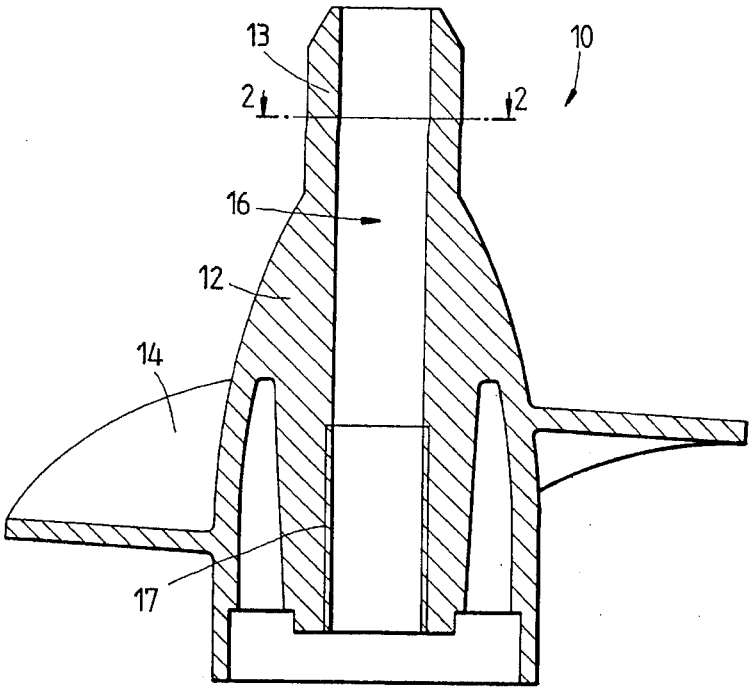
FIG. 1 PRIOR ART
FIG. 1 shows a sectional view taken along the direction of the axis of a motorboat impeller of the prior art.
Figure 2:
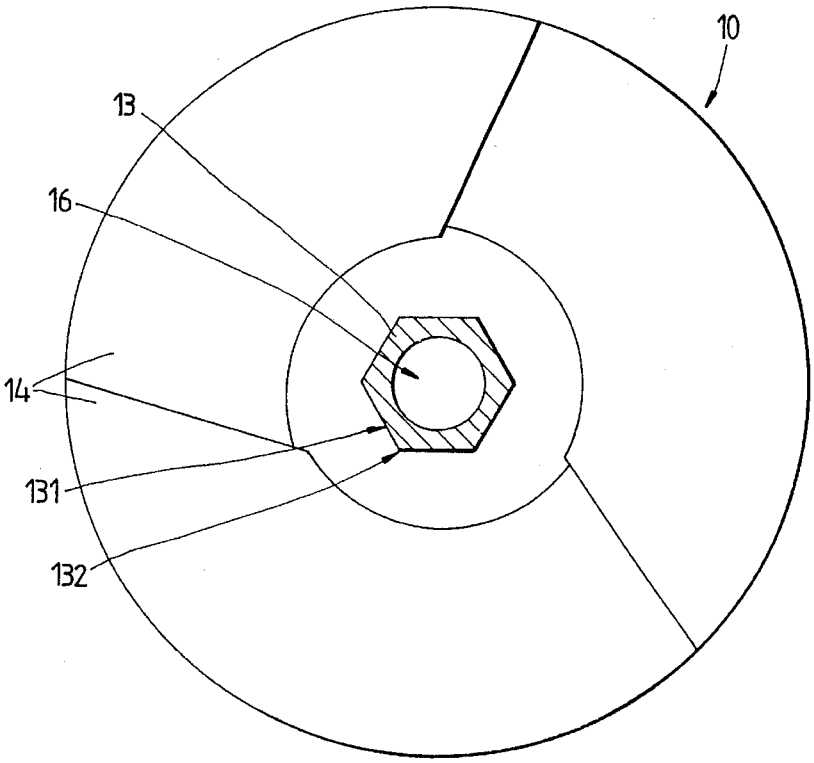
FIG. 2 PRIOR ART
FIG. 2 shows a sectional view taken along the line 2—2 as shown in FIG. 1.
Figure 3:
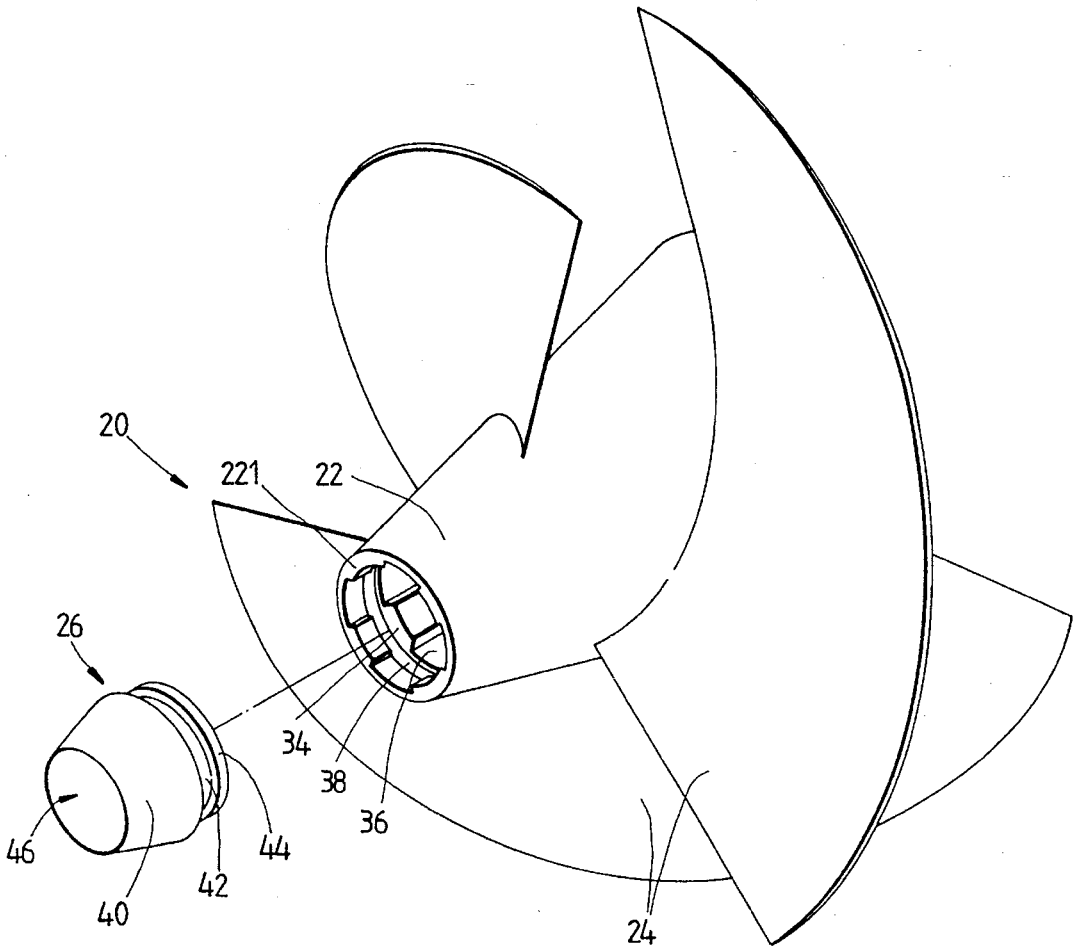
FIG. 3 shows an exploded view of a preferred embodiment of the present invention.
Figure 4:
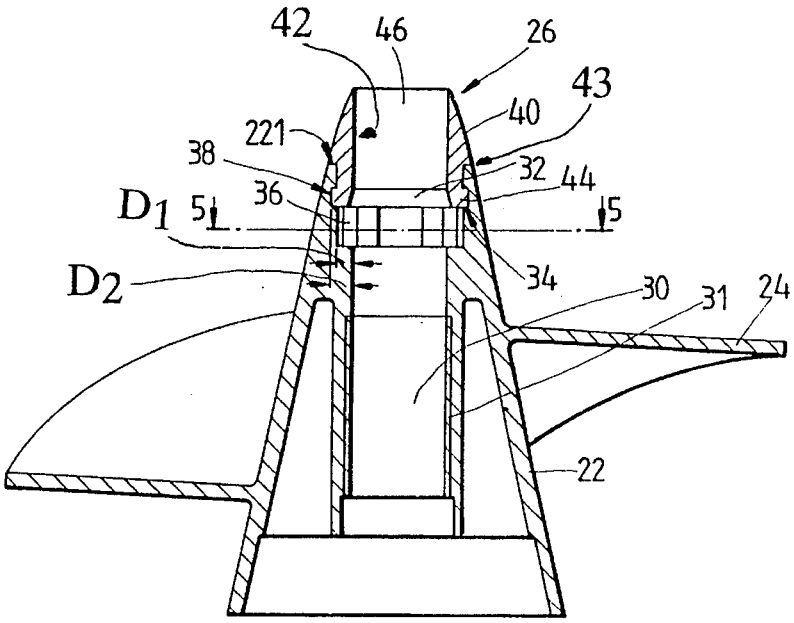
FIG. 4 shows a sectional view taken along the direction of the axis of the preferred embodiment of the present invention.
Figure 5:
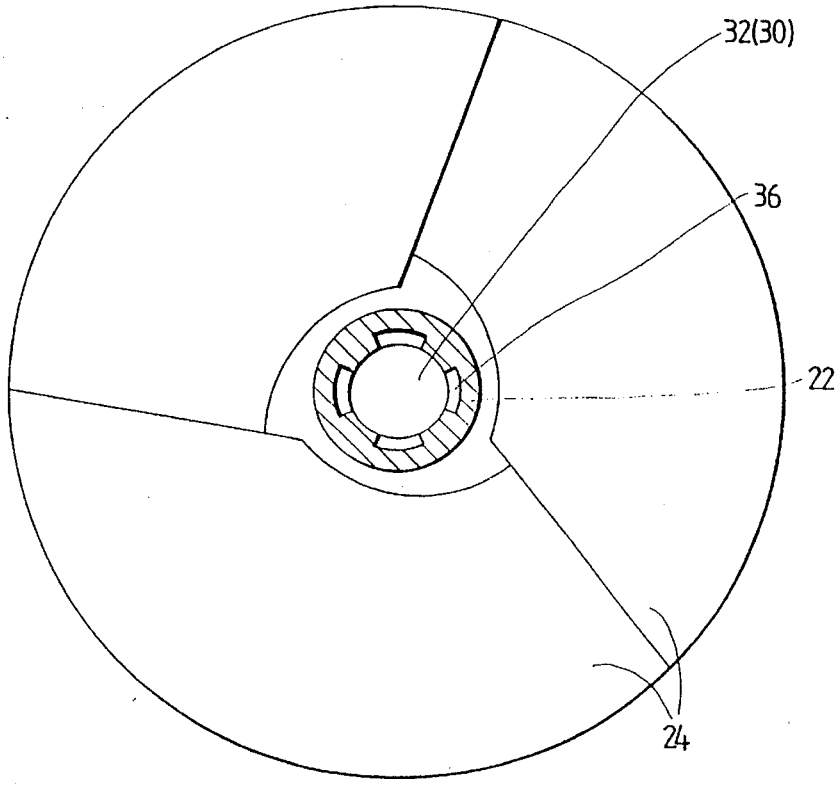
FIG. 5 shows a sectional view taken along the direction indicated by the line 5—5 as shown in FIG. 4.
Figure 6:
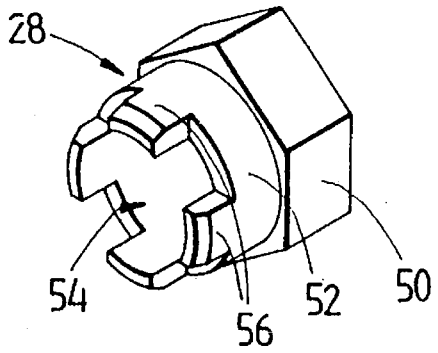
FIG. 6 shows a perspective view of a mounting and dismounting element of the preferred embodiment of the present invention.
Figure 7:
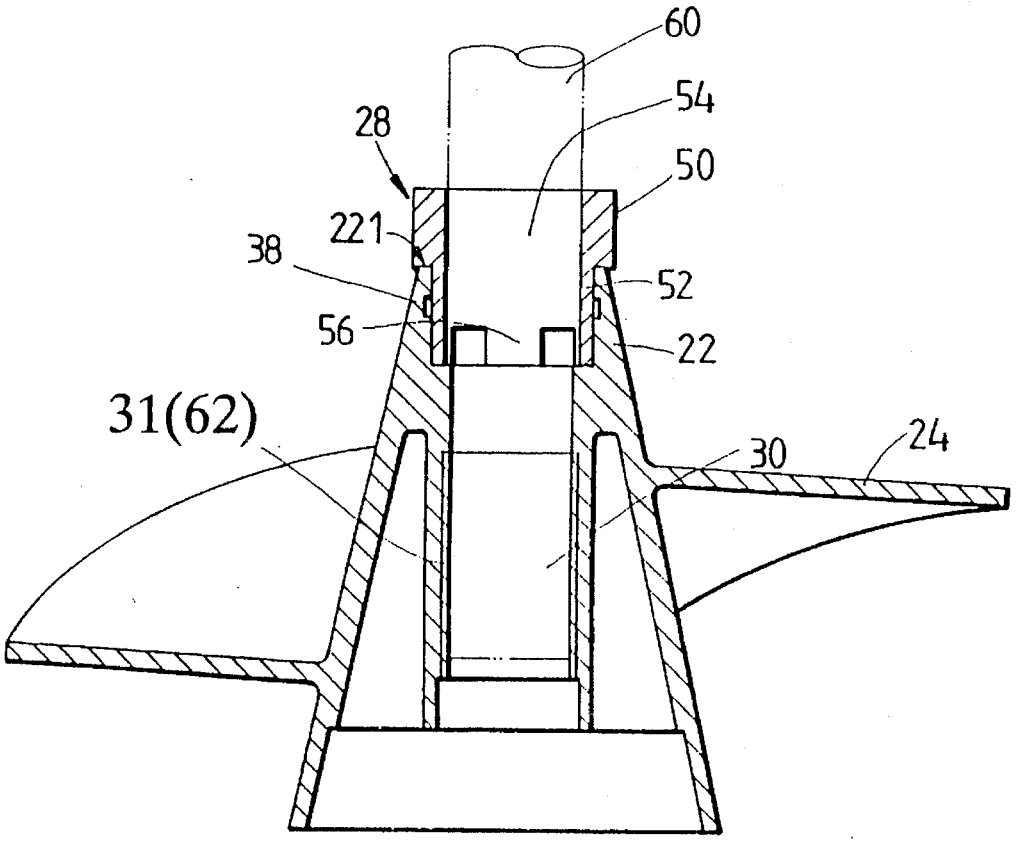
FIG. 7 shows a sectional view taken along the direction of the axis of the preferred embodiment with the mounting and dismounting element being disposed in the axial portion thereof, according to the present invention.

Referring to FIGS. 3–7, a motorboat impeller 20 of the present invention is shown comprising an axial portion 22, three blades 24, a fitting member 26, and a mounting and dismounting element 28.

The axial portion 22 of a conical construction has a front end with a smaller outer diameter and a rear end with a greater outer diameter. The blades 24 are made integrally with the axial portion 22 and are attached to the periphery of the axial portion 22. The axial portion 22 is provided with a first axial hole 30 of an appropriate depth and extending rearward along the direction of the axis of the axial portion 22. The first axial hole 30 is provided with inner threads 31. The axial portion 22 is further provided with a second axial hole 32 coaxial with the first axial hole 30 and extending from the front end of the axial portion 22 toward the rear end of the axial portion 22. The first and the second axial holes 30 and 32 are in communication with each other. The second axial hole 32 has an inner diameter greater than that of the first axial hole 30. Located at the junction between the first and the second axial holes 30 and 32 is a first shoulder 34. The axial portion 22 is still further provided with four retaining slots 36 located equidistantly in the inner wall of the first axial hole 30. The retaining slots 36 have an appropriate length extending rearward from the first shoulder 34 along the direction of the axis of the axial portion 22. The retaining slots 36 have a depth D1 smaller than an inner diameter differential D2 of the first and the second axial holes 30 and 32. The second axial hole 32 is provided in the inner wall thereof with an annular slot 38 which is separated by an appropriate distance from a front end surface 221 of the axial portion 22.

The fitting member 26 of a rubber material has a nose 40, a fastening portion 42, a flange 44, and an axial hole 46. The nose 40 is of a conical construction and has a front end with an outer diameter smaller than an outer diameter of a rear end thereof, with the outer diameter of the rear end being equal to the outer diameter of the front end of the axial portion 22. The fastening portion 42 has an appropriate length extending rearward from the rear end of the nose 40. The fastening portion 42 has an outer diameter equal to the inner diameter of the second axial hole 32, thereby enabling the junction between the nose 40 and the fastening portion 42 to form a second shoulder 43. The flange 44 is disposed around the outer fringe of the fastening portion 42 and is corresponding in location to the annular slot 38. The third axial hole 46 extends through the nose 40 and the fastening portion 42.

The mounting and dismounting element 28 has a body 50, an extension portion 52, a axial hole 54 and four retaining blocks 56, which are all made integrally. The body 50 of a hexagonal construction has an outer diameter greater than the outer diameter of the front end of the axial portion 22. The extension portion 52 of an appropriate length extends rearward from the rear end of the body 50 in the direction of the axis of the body 50. The extension portion 52 has an outer diameter smaller than the inner diameter of the second axial hole 32. The axial hole 54 extends through the nose 50 and the extension portion 52. The four retaining blocks 56 are disposed equidistantly such that they extend rearward for an appropriate length from the tail end of the extension portion 52 along the direction of the axis of the extension portion 52. The four retaining blocks 56 are corresponding in location to the retaining slots 36.

In the process of assemblying the motorboat impeller 20 of the present invention, the extension portion 52 of the mounting and dismounting element 28 is first fitted into the second axial hole 32 such that the retaining blocks 56 are lodged respectively and correspondingly in the retaining slots 36. The axial portion 22 and the mounting and dismounting element 28 are fitted together over the tail end of a driveshaft 60 such that the outer threaded portion 62 of the driveshaft 60 engages the inner threaded portion 31 of the first axial hole 30. In addition, the mounting and dismounting element 28 is clamped with a wrench (not shown) and is then rotated so as to actuate the axial portion 22 to turn by virtue of the engagement of the retaining blocks 56 with the retaining slots 36, thereby enabling the axial portion 22 to be fastened more securely with the driveshaft 60. The mounting and dismounting element 28 can be pushed out from the front end of the axial portion 22 and taken out from another end of the driveshaft 60 in view of the fact that the axial hole 54 has an inner diameter slightly larger than the outer diameter of the driveshaft 60.

The fitting member 26 is then fitted into the driveshaft 60 such that the fastening portion 42 is received in the second axial hole 32, and that the flange 44 is lodged in the annular slot 38, and further that the second shoulder 43 urges the front end surface 221 of the axial portion 22. As a result, the portion between the nose 40 and the axial portion 22 has a streamline profile capable of preventing the formation of turbulence or resistance at such time when the motorboat impeller 20 of the present invention is driven by the driveshaft 60 to rotate at a high speed in the water.

What is claimed is:

1. A motorboat impeller comprising:

an axial portion of a conical construction having a front end with an outer diameter smaller than an outer diameter of a rear end thereof, said axial portion further provided with a first axial hole extending through said front end and said rear end of said axial portion, said first axial hole having in a rear end thereof an inner threaded portion; and a plurality of blades attached to the periphery of said axial portion;

wherein said first axial hole is provided at the front end thereof with a first shoulder extending outward from an axis of said axial portion, and a plurality of retaining slots which are on an inner wall of said first axial hole spaced equidistantly and have a predetermined length extending rearward from said first shoulder in the direction of the axis of said axial portion.

2. The motorboat impeller of claim 1 wherein said axial portion has a third axial hole of a predetermined length and extending rearward from the front end thereof, said third axial hole having an inner diameter greater than an inner diameter of said first axial hole, said third axial hole being contiguous to said first shoulder; and wherein said retaining slots have a depth smaller than an inner diameter differential of said first axial hole and said third axial hole.

3. The motorboat impeller of claim 2 comprising a fitting member which comprises:

a nose of a conical construction and having a front end with an outer diameter smaller than an outer diameter of a rear end thereof;

a fastening portion of a predetermined length and extending rearward from the rear end of said nose along the direction of an axis of said fitting member;

a flange disposed around an outer fringe of said fastening portion; and a fourth axial hole extending through said nose and said fastening portion.

4. The motorboat impeller of claim 3 wherein the outer diameter of the rear end of said nose of said fitting member is equal to said outer diameter of said front end of said axial portion.

5. A motorboat impeller and element for mounting and dismounting said impeller, wherein said motorboat impeller comprises:

an axial portion of a conical construction having a front end with an outer diameter smaller than an outer diameter of a rear end thereof, said axial portion further provided with a first axial hole extending through said front end and said rear end of said axial portion, said axial hole having in a rear end thereof an inner threaded portion; and a plurality of blades attached to the periphery of said axial portion;

wherein said first axial hole is provided at the front end thereof with a first shoulder extending outward from an axis of said axial portion, and a plurality of retaining slots on an inner wall of said first axial hole which are spaced equidistantly and have a predetermined length extending rearward from said first shoulder in the direction of the axis of said axial portion, wherein said element for mounting and dismounting said impeller comprises;

a body portion having a polygonal cross section;

an axial hole extending through a front end and a rear end of said element;

a plurality of retaining blocks having a predetermined length and extending rearward from said rear end along the direction of an axis of said element, said retaining blocks corresponding in location to said retaining slots.

6. The motorboat impeller and element for mounting and dismounting said impeller of claim 5, wherein said axial portion has a second axial hole of a predetermined length and extending rearward from the front end thereof, said second axial hole having an inner diameter greater than an inner diameter of said first axial hole, said second axial hole being contiguous to said first shoulder; and wherein said retaining slots have a depth smaller than an inner diameter differential of said first axial hole and said second axial hole, wherein said element is provided with an extension portion located between said body and each of said retaining blocks; wherein said axial hole extends through said body and said extension portion and has an outer diameter smaller than the inner diameter of said second axial hole; and wherein each of said retaining blocks has a predetermined length and extends rearward from the rear end of said extension portion along the direction of the axis of said element.

7. The motorboat impeller and element to mount and dismount said impeller of claim 5, wherein said axial portion has a second axial hole of a predetermined length and extending rearward from the front end thereof, said second axial hole having an inner diameter greater than an inner diameter of said first axial hole, said second axial hole being contiguous to said first shoulder; and wherein said retaining slots have a depth smaller than an inner diameter differential of said first axial hole and said second axial hole.

* * * * *